US007884777B2

(12) United States Patent
Izadpanah

(10) Patent No.: US 7,884,777 B2
(45) Date of Patent: Feb. 8, 2011

(54) FREE-SPACE-OPTICALLY-SYNCHRONIZED WAFER SCALE ANTENNA MODULE OSILLATORS

(75) Inventor: Hossein Izadpanah, Thousand Oaks, CA (US)

(73) Assignee: Tialinx, Inc., Newport Beach, CA (US)

( * ) Notice: Subject to any disclaimer, the term of this patent is extended or adjusted under 35 U.S.C. 154(b) by 619 days.

(21) Appl. No.: 11/968,079

(22) Filed: Dec. 31, 2007

(65) Prior Publication Data

US 2010/0045565 A1 Feb. 25, 2010

(51) Int. Cl.
*H01Q 21/00* (2006.01)

(52) U.S. Cl. ..... 343/853; 343/700 MS; 342/371

(58) Field of Classification Search ..... 343/700 MS, 343/795, 853; 342/371, 375
See application file for complete search history.

(56) References Cited

U.S. PATENT DOCUMENTS 6,313,792 B1 * 11/2001 Merlet et al. ..... 342/371
7,499,653 B2 * 3/2009 Yap ..... 398/115

* cited by examiner

*Primary Examiner*—Tan Ho
(74) *Attorney, Agent, or Firm*—Haynes & Boone, LLP.

(57) ABSTRACT

In one embodiment, a device is disclosed that includes: a first substrate, a plurality of antennas adjacent the first substrate; a plurality of oscillators integrated in the first substrate, each oscillator providing an output signal to drive a corresponding subset of the antennas; and a plurality of photodetectors corresponding to plurality of oscillators, each oscillator being adapted to injection lock its output signal to an electronic photodetector signal from the photodetector produced in response to an illumination of the photodetectors with a free-space optical signal modulated such that the photodetector signals are globally synchronized with each other, whereby the output signals driving the plurality antennas are also globally synchronized across the plurality of antennas.

19 Claims, 5 Drawing Sheets

FREE-SPACE-OPTICALLY-SYNCHRONIZED WAFER SCALE ANTENNA MODULE OSILLATORS

TECHNICAL FIELD

The disclosure relates generally to oscillators and more particularly to a free-space-optically-synchronized integrated circuit.

BACKGROUND

Conventional radio-wave beamforming applications typically use machined waveguides as feed structures, requiring expensive micro-machining and hand-tuning. Not only are these structures difficult and expensive to manufacture, they are also incompatible with integration to standard semiconductor processes. As is the case with individual conventional high-frequency antennas, beamforming arrays of such antennas are also generally difficult and expensive to manufacture. In addition, phase-shifters are required that are incompatible with a semiconductor-based design. Moreover, conventional beam-forming arrays become incompatible with digital signal processing techniques as the operating frequency is increased. For example, at the higher data rates enabled by high frequency operation, multipath fading and cross-interference becomes a serious issue. Adaptive beamforming techniques are known to combat these problems. But adaptive beamforming at 10 GHz or higher frequencies requires massively parallel utilization of A/D and D/A converters.

To address these problems, integrated circuit approaches have been developed in which the electrical feed lines and structure, active circuitry, and the antennas are all associated with a semiconductor substrate. To enhance the number of available antenna elements, a wafer scale substrate may be used such that the resulting beamforming system may be denoted as a "wafer scale antenna module." Each antenna element in such a module may be driven with a properly-phased signal so as to transmit a signal into a desired beam-steered direction. Similarly, received signals must also be properly-phased if a particular receive direction is to be selected through beamforming. A number of "wired" driving architectures have been developed to drive the antennas. For example, each antenna (or sub-array of antennas) may be associated with an oscillator. The aggregation of an antenna (or antennas) and its oscillator may be denoted as an integrated antenna circuit. Alternatively, a centralized oscillator may be used to drive an electrically wired feed network such that the resulting signal propagating through the feed network drives the antenna elements (ignoring any phase-shifting of the propagated signal for beamforming purposes). As discussed in commonly-assigned U.S. application Ser. No. 11/141,283, a feed structure may be formed using co-planar waveguides or microstrip formed using the metal layers formed in the wafer's semiconductor manufacturing process. A synchronization signal to be transmitted is injected into an input port for the feed network whereupon the signal propagates through the feed network to the individual antenna elements. U.S. application Ser. No. 11/141,283 disclosed a distributed amplification architecture to address the substantial propagation losses introduced as the input signal propagates across the feed network.

Although the propagation losses are addressed in this fashion, a signal will also tend to degrade through dispersion as it propagates through the "wired" feed line network. Thus, commonly-assigned U.S. application Ser. No. 11/555,210 discloses an integrated antenna circuit architecture wherein each antenna (or sub-array of antennas) associates with its own oscillator. Because no signal need be driven across the wafer from a centralized oscillator to the antennas, the integrated circuit architecture advantageously has less dispersion as the signal to be propagated is generated locally and thus has relatively little dispersion introduced in the oscillator-to-antenna propagation path. An issue exists, however, in integrated antenna circuit architectures of keeping the various oscillators in synchronization. As disclosed in commonly-assigned U.S. application Ser. No. 11/555,210, a distributed amplification feed network may be modified such that the entire network resonantly oscillates in unison. The integrated antenna circuits may thus be synchronized through phase-locked loops or other techniques with regard to the globally-synchronized signal provided by the resonant feed line network. Although a resonant feed network thus provides global synchronization of the integrated antenna circuits, it is a substantial "tethered" structure to design and demands a lot of substrate space. In that regard, each integrated antenna circuit oscillator is required to be highly stable in phase and frequency with very low values of phase noise to permit accurate array phase control for beam steering. Synchronizing these oscillators through a resonant network uses valuable wafer real estate budget. In addition, the fine structure of the resonant feed is subject to attenuation, which increases with frequency, and thus increases the wafer power dissipation and eats up the wafer power budget. Moreover, there is the issue of on wafer signal propagation cross talk with other signal lines and devices and the major issue of the "near-far" effect of signal "differential" delay and latency to each of the oscillators. In addition, the un-avoidable on-wafer resonant propagation is subject to highly-frequency dependent phase distortion. These issues affect array phase control accuracy.

Accordingly, there is a need in the art for alternative synchronization, preferably "tetherless and optical" techniques for integrated-antenna-circuit-containing wafer scale antenna modules.

SUMMARY

In accordance with an embodiment of the invention, a device is provided that includes: a first substrate, a plurality of antennas adjacent the first substrate; a plurality of oscillators integrated in the first substrate, each oscillator providing an output signal to drive a corresponding subset of the antennas; and a plurality of photodetectors corresponding to plurality of oscillators, each oscillator being adapted to injection lock its output signal to an electronic photodetector signal from the photodetector produced in response to an illumination of the photodetectors with a free-space optical signal modulated such that the photodetector output signals are globally synchronized with each other, whereby the output signals driving the plurality antennas are also globally synchronized across the plurality of antenna elements.

The invention will be more fully understood upon consideration of the following detailed description, taken together with the accompanying drawings.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Reference will now be made in detail to one or more embodiments of the invention. While the invention will be described with respect to these embodiments, it should be understood that the invention is not limited to any particular embodiment. On the contrary, the invention includes alternatives, modifications, and equivalents as may come within the spirit and scope of the appended claims. Furthermore, in the following description, numerous specific details are set forth to provide a thorough understanding of the invention. The invention may be practiced without some or all of these specific details. In other instances, well-known structures and principles of operation have not been described in detail to avoid obscuring the invention.

An optical synchronization technique is disclosed that provides a globally-synchronized signal to integrated antenna circuits. Each integrated antenna circuit associates with a photodetector that is also integrated with the semiconductor substrate supporting the array of integrated antenna circuits. If these photodetectors are illuminated with light modulated according to a master oscillator frequency, the photodetectors will produce an electric signal having a frequency equaling the master oscillator frequency. In this fashion, each photodetector provides an electric photodector signal that is globally synchronized with the remaining photodetector signals. Each integrated antenna circuit includes an oscillator adapted to provide an output signal that is synchronized with the globally synchronized photodetector signal. In one embodiment, the integrated antenna circuit oscillators are adapted to injection lock by the photodetector signals. In other embodiments, the integrated antenna circuit oscillators may synchronize to the associated photodetector signal through, for example, a phase-locked loop.

Figure 1:
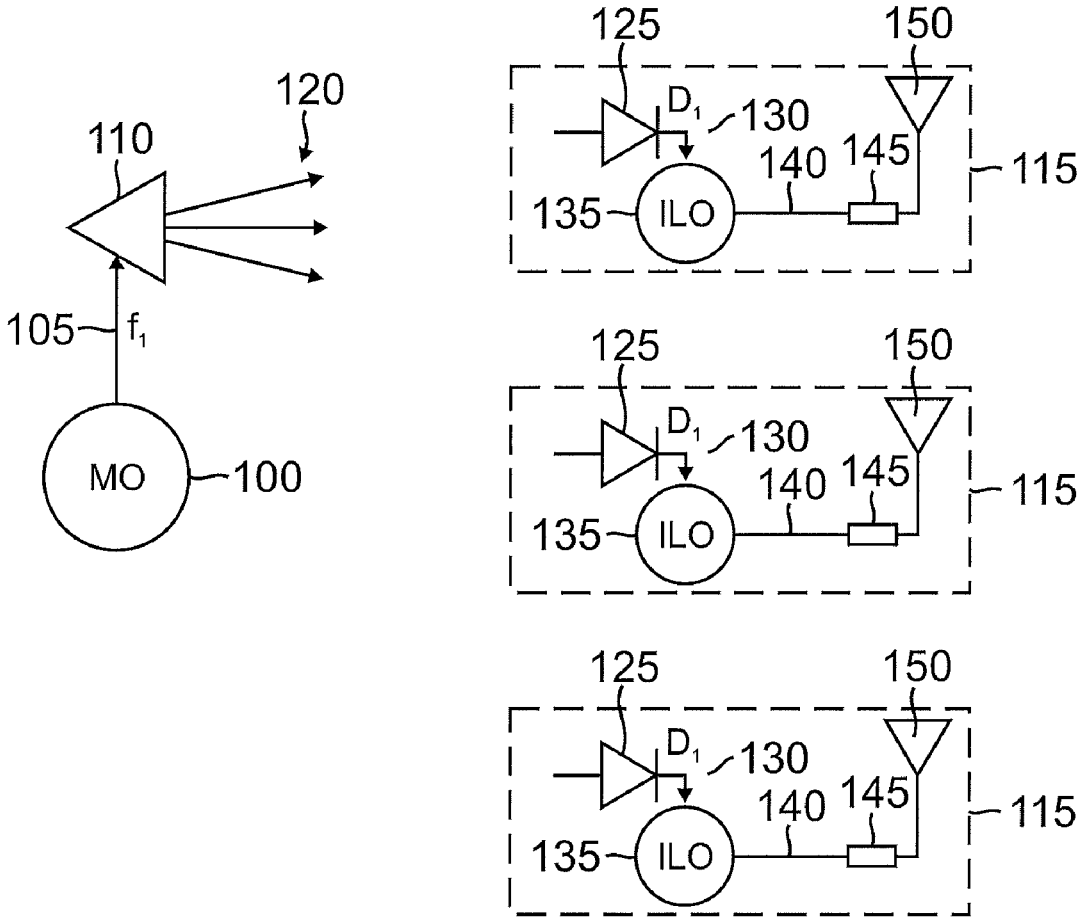
FIG. 1 is a block diagram of an optically-synchronized antenna array.

Turning now to FIG. 1, an overview of the optically-synchronized antenna array is illustrated. A master oscillator 100 provides a master oscillator signal 105 having a modulation frequency (or frequencies) denoted as $f_1$. The master oscillator should be highly stable such as, for example, a crystal-controlled VCO. A laser light source 110 illuminates a plurality of integrated antenna circuits with coherent light 120 modulated according to the master oscillator frequency $f_1$. Numerous optical light sources may be used such as, for example, a laser, edge or surface emitting LED, or a multiple combined VCSEL source. A particularly advantageous modulation of the laser light source occurs if source 110 comprises an actively modulated mode-locked laser (MLL) that produces a series of frequency comb lines separated in frequency equal to that of the master oscillator frequency $f_1$. However, source 110 may also comprise, for example, a single laser diode modulated by the master oscillator such that coherent light 120 is amplitude-modulated according to master oscillator frequency $f_1$.

A photodetector 125 associated with each integrated antenna circuit produces a photodetector signal 130 that is modulated with master oscillator frequency $f_1$. As discussed above, a number of configurations exist to synchronize an oscillator to the photodetector signal. However, because an injection-locking architecture advantageously provides component simplicity yet tightly-coupled global synchronization across the oscillators, the following discussion will assume without loss of generality that each integrated antenna circuit includes an injection-locked oscillator (ILO) 135 configured to injection lock by the associated photodetector signal. It will thus be appreciated that each ILO 135 provides an output signal 140 that is globally synchronized across the array of integrated antenna circuits. Each ILO drives an antenna 150 (or sub-array of antennas) to produce a transmitted signal. To allow for electronic beam steering, each integrated antenna circuit may include a phase-shifter 145 such as the analog phase-shifter described in commonly-assigned U.S. application Ser. No. 11/535,928 that phase-shifts signal 140 before it is driven into the associated antenna(s). A controller (not illustrated) drives the phase-shifters with the appropriate commands so as to steer the transmitted beam as desired.

As discussed, for example, in commonly-assigned U.S. application Ser. No. 11/555,210, the antennas (such as for example, patches or dipoles) may be formed by appropriately configuring the metal layers used in the semiconductor manufacturing process. In such an embodiment, the active components (such as the photodetectors, ILOs, and any phase-shifters) integrated with the semiconductor substrate are associated with the same side of the substrate as are the antennas. Alternatively, the active components may be formed on the opposing side of the substrate as compared to the side associated with the antennas. Such a "backside" approach has the advantage of isolating the active and OE components from the antennas. However, as discussed in U.S. application Ser. No. 11/555,210, semiconductor metal layers would no longer be available to form the antennas in a backside architecture. Instead, the antennas may be formed as discussed in U.S. application Ser. No. 11/555,210, the contents of which are hereby incorporated by reference in their entirety.

Figure 2:
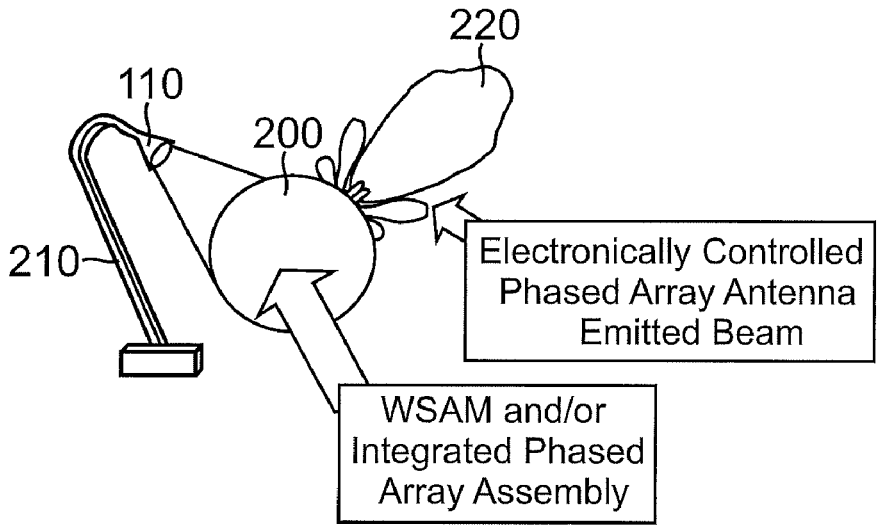
FIG. 2 illustrates a laser source synchronizing a wafer-scale antenna module (WSAM).

As shown in FIG. 1, each integrated antenna circuit may be associated with the same semiconductor substrate or different semiconductor substrates. A particularly advantageous WSAM embodiment is achieved if the integrated antenna circuits are integrated onto a common wafer scale substrate. Such a WSAM substrate 200 is shown in FIG. 2 being illuminated by a laser source 110. A frame 210 holds the laser source so it may illuminate, by a Free-Space Optical (FSO) signal projection the WSAM substrate. The technique leads to a tetherless control and synchronization by projected optical signals. A resulting electronically-steered beam 220 (assuming phase-shifters are included within the WSAM) thus projects from the WSAM into a desired beam direction. It will be appreciated that the laser source need not be co-located with the WSAM as shown but instead may be located remotely from the WSAM and fiber optics used to propagate the coherent light from the source to a suitable position to illuminate the WSAM. Fiber optics have useful optical characteristics which include low loss, flexibility in length and physical positioning, the potential of integrated lens formation at its end for focusing and directing the light to a specified position, and the ability to carry more than one optical signal (such as in WDM or DWDM schemes) for reconfigurable operation and addressing each integrated antennas circuit oscillator differently, if required. To ensure that the coherent light illuminates all the photodetectors across the WSAM, a variety of projection means may be implemented such as a broad and expanding beam projection method, a collimated parallel beam, or optical MIMO/O-MEM schemes.

Figure 3:
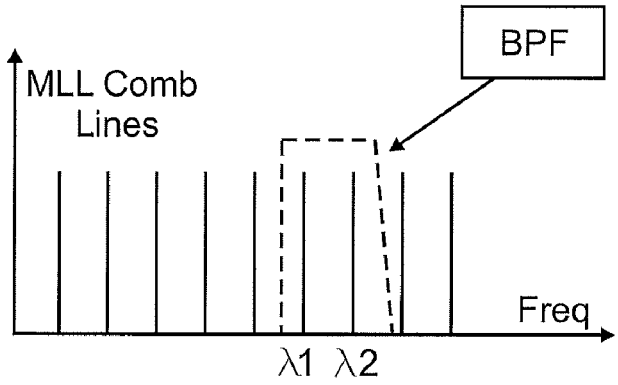
FIG. 3 illustrates a spectral output from a mode-locked laser (MLL) source.
Figure 4:
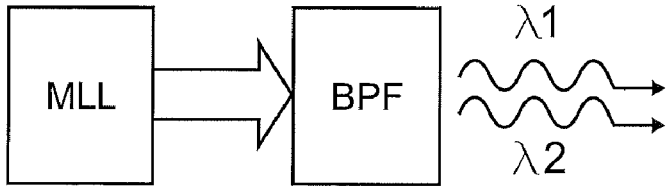
FIG. 4 is a block diagram of an MLL source and a bandpass filter for two wavelengths selection.

As discussed earlier, a particularly advantageous form of laser source involves the use of beat note from a dual frequency laser source or two comb lines selected from the comb lines of a mode-locked laser (MLL). Other suitable dual frequency sources include two phase-locked stable independent laser emitters or a dual-wavelength highly stabilized laser diode emitter. As known in the art, an MLL will produce comb lines separated in frequency by harmonics of the master oscillator signal frequency $f_1$ used to modulate the MLL. The resulting comb line spectrum from such a modulated MLL is illustrated in FIG. 3. An optical bandpass filter having a bandpass spectrum as illustrated by the dotted line will allow the selection of only two adjacent comb lines which is separated by f1 at wavelengths λ1 and λ2 to illuminate the integrated photodetector and antenna circuits. The resulting laser source is shown in FIG. 4 to comprise an MLL 400 and a bandpass filter 405. Given such an illumination, the total field E(t) incident on the photodiodes is:

$$E(t)=E1(t)\cos(\omega 1t+\phi 1)+E2(t)\cos(\omega\ 2t+\phi 2)$$

where E1(*t*) corresponds to the optical field resulting from the comb line having wavelength λ1 and E2(*t*) corresponds to the optical field resulting from the comb line having wavelength λ2. The photodetector signal such as a photodiode output current i(t) is proportional to a photodiode responsivity Rd and an optical intensity Ip in the two wavelengths and is thus given by $$i(t)=Rd\cdot E^2(t)$$

where $E^2(t)$ is written in terms of frequency and phase as;

$$E^2(t)=[E1(t)\cos(\omega 1t+\phi 1)+E2(t)\cos(\omega\ 2t+\phi 2)]^2$$

Substituting this value into the expression for the photodiode current i(t) provides:

$$i(t)=\tfrac{1}{2}E^2_1(t)+\tfrac{1}{2}E^2_2(t)+E1(t)E2(t)\cos\ [(\omega 1-\omega 2)t+(\ 1-\phi 2)]$$

For an ac-coupled photodiode, the output current is thus given by;

$$(t)\sim E1(t)E2(t)\cos\ [(\omega 1-\omega 2)t+(\ 1-\phi 2)]$$

Therefore the photodiode output current is an RF signal at the beat frequency of ω1−ω2) with a well defined phase of ( 1−φ2). The resulting signal phase obtained here is thus fixed and pre-set by the coherent MLL original optical source. It will be reproduced and "preserved" during the optical-electronic (OE) conversion process by the photodetector. Advantageously, this photodetector synchronizing signal will be independent of the path length between the photodiode and the laser source. The synchronizing signal phase is also independent of the optical projection path length and any differential path length (within the optical wavelength of approximately micron value) from the launching point experienced by different ray trajectory. It will thus be appreciated that the use of this two wavelength sync functionality, by itself, will remove many of problems encountered by the wired electrical synchronization mentioned above. In addition the optical system is tetherless (no fiber or waveguide interconnect) but purely by the Free-Space optical illumination, its use will eliminate the differential path delays thereby no phase discrepancy. Moreover, the system reduces the system design and operation complexity, thereby reducing the over all cost and power consumption leading to enhancing the system performance.

Figure 5:
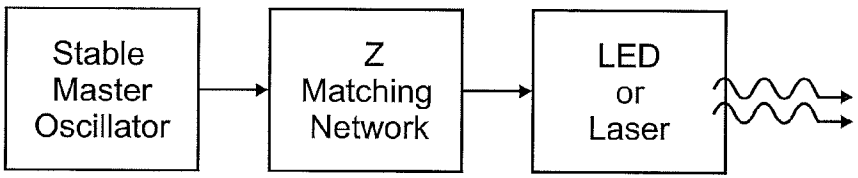
FIG. 5 is a block diagram of a master oscillator source modulating a single-wavelength laser or LED source through an impedance matching network.
Figure 6:
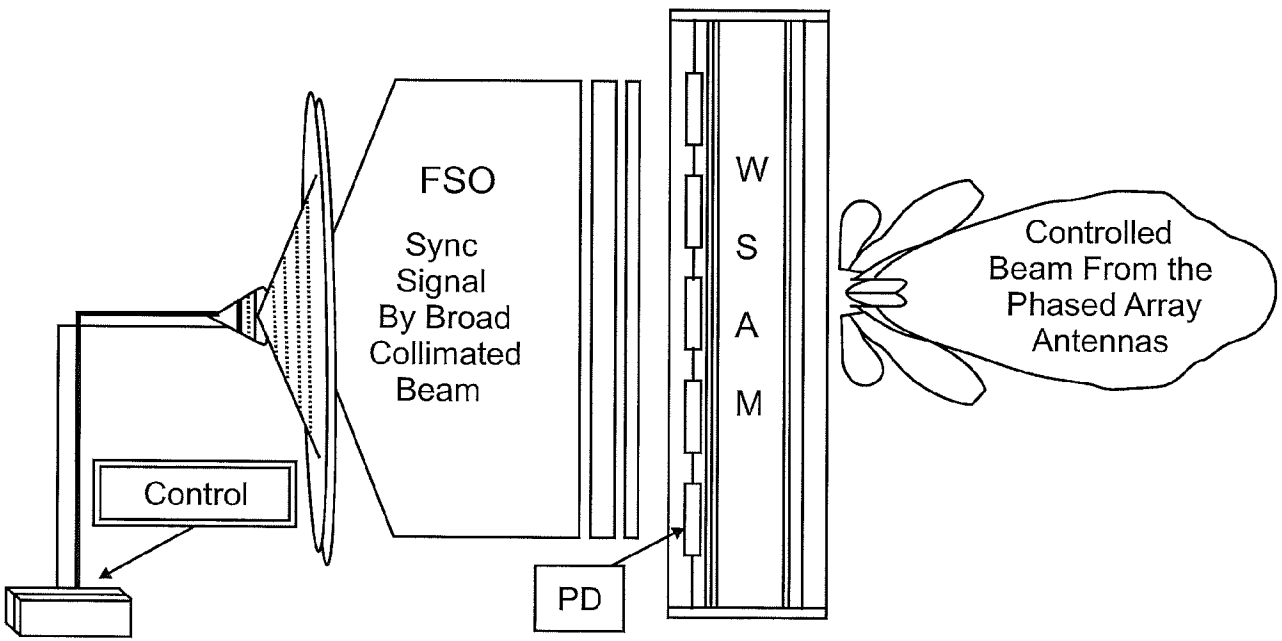
FIG. 6 illustrates a backside-integrated WSAM.illumination by a collimated optical beam

As an alternative to a dual-wavelength source, a single wavelength optical sources may be used as discussed previously. FIG. 5 illustrates an example embodiment in which a master oscillator modulates an LED or laser source through an impedence (Z) matching network. In this case the optical signal is amplitude modulated by the master oscillator signal at the intended RF frequency. Each photodetector recovers the intended RF frequency by envelope detects the modulated coherent light. Because the photodetector is thus demodulating the amplitude-modulated coherent light illumination, it will be appreciated that the resulting photodetector synchronizing signal will have a phase dependent on the projected propagation length from the laser source to the particular photodetector. To minimize this desynchronizing propagation-length phase dependence, a collimated beam may be used as shown in FIG. 6. In this embodiment, the WSAM uses the backside approach discussed previously. By locating the photo detectors and associated circuitry on the wafer side opposite to the antennas provides integration and manufacturing flexibility, lowers the system design complexity, and allows more efficient optical power transfer and projection schemes. In addition the optical and the electronic beam propagation direction do not overlap or blocks each other path in a backside embodiment.

Figure 7:
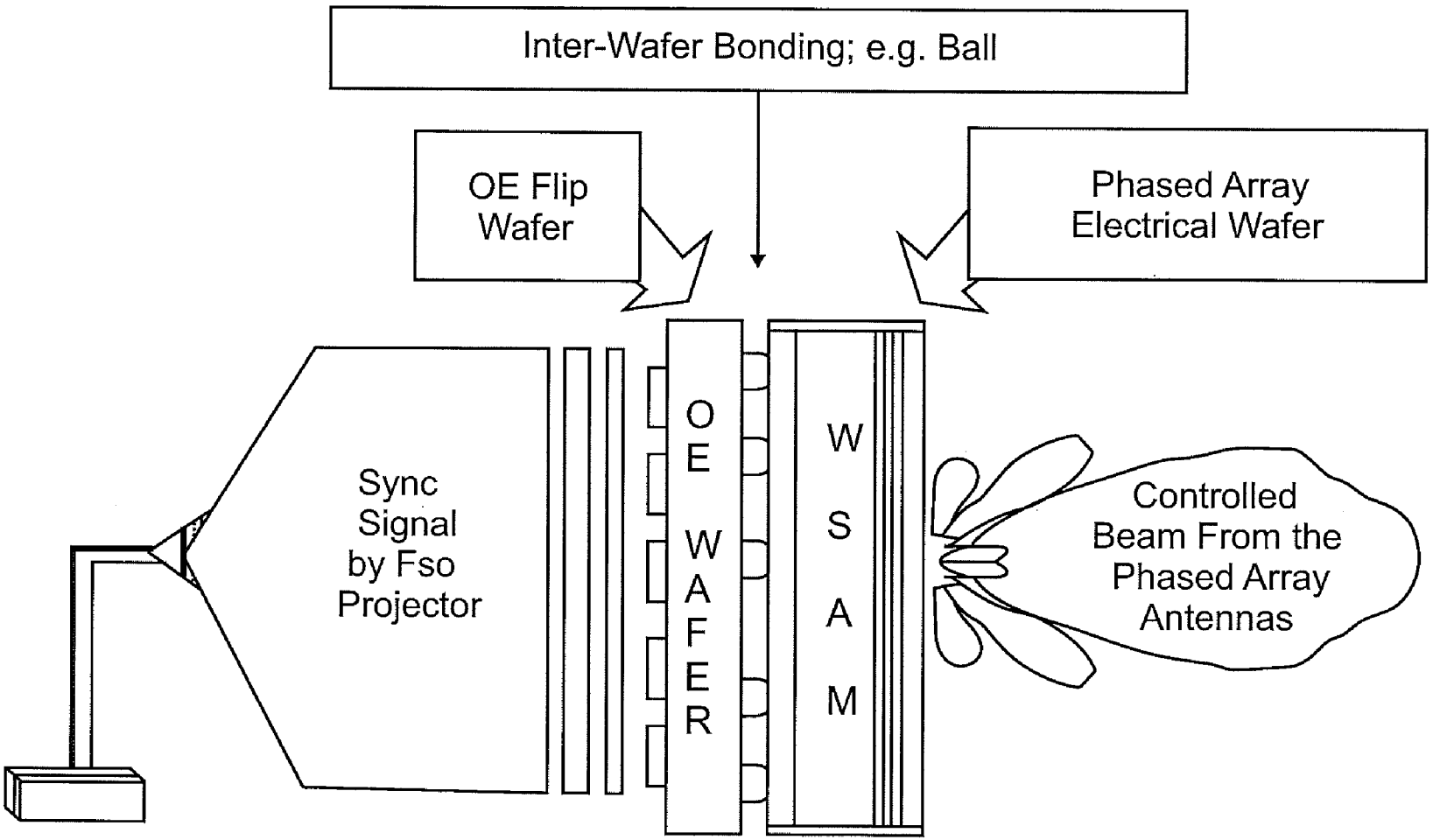
FIG. 7 illustrates a flip-chip mounted photodetector substrate attached to the backside of a WSAM.

Each photodetector may be formed using, for example, GaAs or InP processes that may be incompatible with a Si or SiGe wafer substrate. Thus, the photodetectors may be formed on a separate substrate as shown in FIG. 7 that is, for example, flip-chip mounted to the antenna substrate.

Figure 8A:
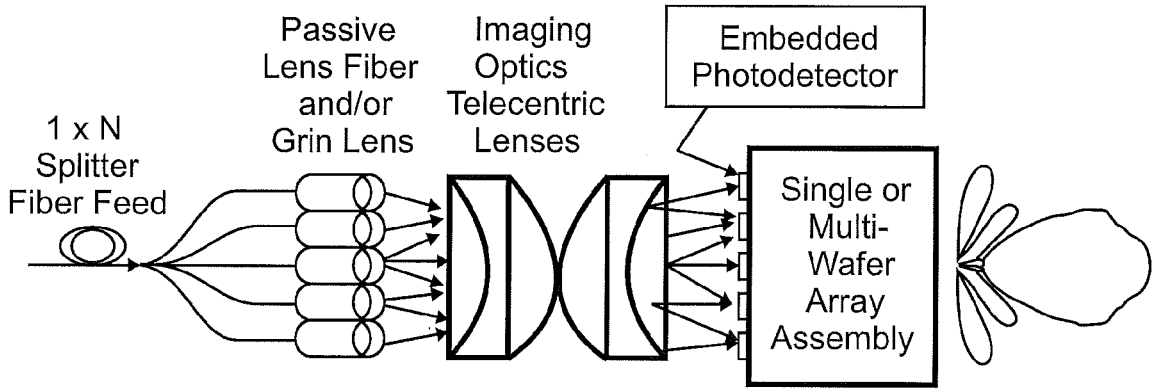
FIG. 8*a* illustrates an array of lensed fibers for concentrating the illumination on the photodetectors.
Figure 8B:
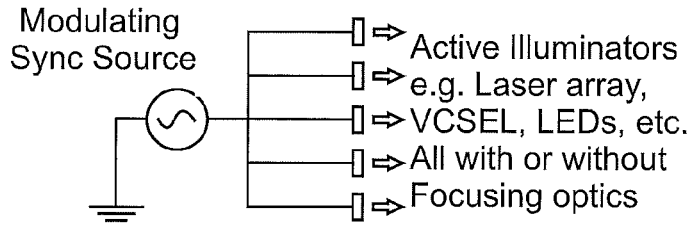
FIG. 8*b* illustrates an array of active illuminators for concentrating the illumination on the photodetectors.

Although the optically synchronized arrays discussed herein have been described with respect to particular embodiments, this description is only an example of certain applications and should not be taken as a limitation. For example, rather than illuminate the antenna substrate uniformly, the coherent light may be concentrated to the areas containing the photodetectors, through the use of GRIN lensed fiber as shown in FIG. 8*a*. In addition, imaging lenses may be used to assist in focusing the concentrated illumination onto the photodetectors. Alternatively, an a array of active illuminators may be used as shown in FIG. 8*b* such as a laser array, an array of VCSELs, an array of LEDs, or other suitable active illuminators. Thus, those of ordinary skill will appreciate that alternative embodiments may be constructed according to the principles discussed above. Consequently, the scope of the claimed subject matter is set forth as follows.

I claim:

1. A device, comprising:

a first substrate, a plurality of antennas adjacent the first substrate;

a plurality of oscillators integrated in the first substrate, each oscillator providing an output signal to drive a corresponding subset of the antennas; and a plurality of photodetectors corresponding to plurality of oscillators, each oscillator being adapted to be injection lock its output signal to an electronic photodetector signal from the photodetector produced in response to an illumination of the photodetectors with a free-space optical signal modulated such that the photodetector signals are globally synchronized with each other, whereby the output signals driving the plurality antennas are also globally synchronized across the plurality of antennas.

2. The device of claim 1, wherein the first substrate comprises a semiconductor wafer.

3. The device of claim 1, wherein each photodetector is a photodiode.

4. The device of claim 1, wherein the antennas are adjacent a first side of the first substrate and the oscillators are integrated into an opposing side of the first substrate.

5. The device of claim 4, further comprising a second substrate, wherein the photodetectors are integrated into the second substrate, the second substrate being coupled to the opposing side of the first substrate.

6. The device of claim 4, wherein the antennas comprise dipole antennas.

7. The device of claim 4, wherein the antennas comprise patch antennas.

8. The device of claim 6, wherein the dipole antennas are formed in semiconductor process metal layers.

9. The device of claim 1, further comprising a plurality of phase-shifters corresponding to the plurality of oscillators, each phase-shifter being configured to phase-shift the output signal from it corresponding oscillator such that the subset of antennas corresponding to each oscillator is driven by a phase-shifted version of the output signal from the oscillator.

10. A method of synchronizing a plurality of antennas, comprising:

modulating a dual-frequency optical signal according to a master oscillation frequency;

illuminating a plurality of photodetectors with the modulated dual-frequency optical signal, each photodetector thereby providing a synchronized photodetector signal having a frequency matching the master oscillation frequency;

injection locking a plurality of oscillators by the synchronized photodetector signals such that each oscillator injection locks on a one-on-one basis with a corresponding one of the synchronized photodetector signals to provide a plurality of synchronized oscillator signals corresponding to the plurality of antennas; and driving each of the antennas with a version of the corresponding synchronized oscillator signal.

11. The method of claim 10, wherein the modulated dual-frequency optical signal comprises two comb signals.

12. The method of claim 10, further comprising phase-shifting each synchronized oscillator signal to provide a phase-shifted version of the synchronized oscillator signal, wherein driving each of the antennas with a version of the corresponding synchronized oscillator signal comprises driving each of the antennas with the corresponding phase-shifted version.

13. A system, comprising:

a master oscillator providing a master oscillator signal;

a laser source modulated by the master oscillator signal so as to provide modulated coherent light;

a first substrate, a plurality of antennas adjacent the first substrate;

a plurality of oscillators integrated in the first substrate, each oscillator providing an output signal to drive a corresponding subset of the antennas; and a plurality of photodetectors corresponding to plurality of oscillators, each oscillator being adapted to injection lock its output signal to an electronic photodetector signal from the photodetector produced in response to an illumination of the photodetectors with the modulated coherent light.

14. The system of claim 13, wherein the first substrate comprises a semiconductor wafer.

15. The system of claim 13, wherein each photodetector is a photodiode.

16. The system of claim 13, wherein the antennas are adjacent a first side of the first substrate and the oscillators are integrated into an opposing side of the first substrate.

17. The system of claim 16, further comprising a second substrate, wherein the photodetectors are integrated into the second substrate, the second substrate being coupled to the opposing side of the first substrate.

18. The system of claim 16, wherein the antennas comprise dipole antennas.

19. The system of claim 16, wherein the antennas comprise patch antennas.

* * * * *